US008873987B2

(12) United States Patent
Nozawa et al.

(10) Patent No.: US 8,873,987 B2
(45) Date of Patent: Oct. 28, 2014

(54) IMAGE FORMING APPARATUS, CONTROL METHOD, AND RECORDING MEDIUM

(75) Inventors: Taizo Nozawa, Kanagawa-ken (JP); Yukio Futamata, Shizuoka-ken (JP); Noboru Furuyama, Kanagawa-ken (JP); Satoshi Itaya, Shizuoka-ken (JP); Hiroshi Katakura, Shizuoka-ken (JP); Setsuo Takada, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 367 days.

(21) Appl. No.: 13/164,095

(22) Filed: Jun. 20, 2011

(65) Prior Publication Data

US 2011/0311257 A1 Dec. 22, 2011

Related U.S. Application Data

(60) Provisional application No. 61/356,879, filed on Jun. 21, 2010.

(51) Int. Cl.
*G03G 15/20* (2006.01)

(52) U.S. Cl.
CPC ..... *G03G 15/2078* (2013.01)
USPC ..... 399/70

(58) Field of Classification Search
CPC ..... G03G 15/2039; G03G 15/205; G03G 15/2078; G03G 15/2042
USPC ..... 399/69, 70
See application file for complete search history.

(56) References Cited

U.S. PATENT DOCUMENTS

| | | | | |
|---|---|---|---|---|
| 6,516,166 | B2 * | 2/2003 | Sakakibara et al. | 399/69 |
| 7,565,087 | B2 * | 7/2009 | Matsusaka et al. | 399/69 |
| 2003/0161651 | A1 * | 8/2003 | Tatematsu et al. | 399/69 |
| 2007/0071523 | A1 * | 3/2007 | Suzuki | 399/329 |
| 2009/0310998 | A1 * | 12/2009 | Otsuka | 399/70 |
| 2009/0317102 | A1 * | 12/2009 | Hasegawa et al. | 399/45 |
| 2011/0064441 | A1 | 3/2011 | Morihara | |

* cited by examiner

*Primary Examiner* — Walter L Lindsay, Jr.
*Assistant Examiner* — Frederick Wenderoth
(74) *Attorney, Agent, or Firm* — Amin, Turocy & Watson, LLP

(57) ABSTRACT

An embodiment provides an image forming apparatus including: a job acquiring unit that acquires an image forming job that gives instructions for performing forming of an image; an image forming process control unit that controls performance of the image forming job that the job acquiring unit acquires; a temperature information acquiring unit that acquires information showing temperature of the heating rotary body; a determining unit that determines whether the temperature of the heating rotary body which is acquired by the temperature information acquiring unit is equal to or higher than a predetermined stand-by temperature set as a temperature in a stand-by state that stands by to perform the image forming process, when the image forming process is completed, based on the image forming job by the image forming process control unit; and a fixing device control unit.

17 Claims, 5 Drawing Sheets

IMAGE FORMING APPARATUS, CONTROL METHOD, AND RECORDING MEDIUM

CROSS-REFERENCE TO RELATED APPLICATIONS

This application is based upon and claims the benefit of priority from U.S. provisional application 61/356879, filed on Jun. 21, 2010; the entire contents of which are incorporated herein by reference.

FIELD

Embodiments described herein relate generally to fixing control in an image forming apparatus.

BACKGROUND

In electrophotographic type image forming apparatuses, an image is formed by fixing a toner image, which is transferred on a sheet, onto the sheet by heating and pressing the toner image. As a fixing device for performing the fixing, there is a type composed of a heating roller that is heated and a pressure roller that is in contact with the heating roller by predetermined pressure or a type composed of a heating belt suspended on a roller and heated and a pressure roller opposite to the heating belt.

In the related art, when fixing is performed by the fixing device, the surface opposite to the fixed surface in both surfaces of a sheet is occasionally tainted.

DETAILED DESCRIPTION

According to an embodiment, an image forming apparatus includes a fixing device, a job acquiring unit, an image forming process control unit, a temperature information acquiring unit, a determining unit, and a fixing device control unit. The fixing device includes a heating rotary body that fixes toner onto a sheet by heating the toner on the sheet, a pressing body that forms a nip portion with the heating rotary body, and conveys the sheet together with the heating rotary body, with the sheet interposed therebetween, and a heating member that heats the heating rotary body. The job acquiring unit acquires an image forming job that gives instructions for performing image forming. The image forming process control unit controls the performance of the image forming job that the job acquiring unit acquires. The temperature information acquiring unit acquires information showing the temperature of the heating rotary body. The determining unit determines whether the temperature of the heating rotary body which is acquired by the temperature information acquiring unit is equal to or larger than predetermined stand-by temperature set as the temperature in a stand-by state that stands by to perform the image forming process, when the image forming process is completed, based on the image forming job by the image forming process control unit. The fixing device control unit, which controls the fixing device, performs a first stand-by control process that increases the temperature of the heating rotary body to the stand-by temperature by heating the heating rotary body with the heating member while rotating the heating rotary body with the heating rotary body and the pressing body in contact, when the determining unit determines that the temperature of the heating rotary body is lower than the stand-by temperature. Further, the fixing device control unit performs a second stand-by control process that stops the rotation of the heating rotary body and makes the fixing device stand by, without heating the heating rotary body with the heating member, when the determining unit determines that the temperature of the heating rotary body is the stand-by temperature or higher.

Hereinafter, an embodiment will be described with reference to the drawings.

First Embodiment

Figure 1:
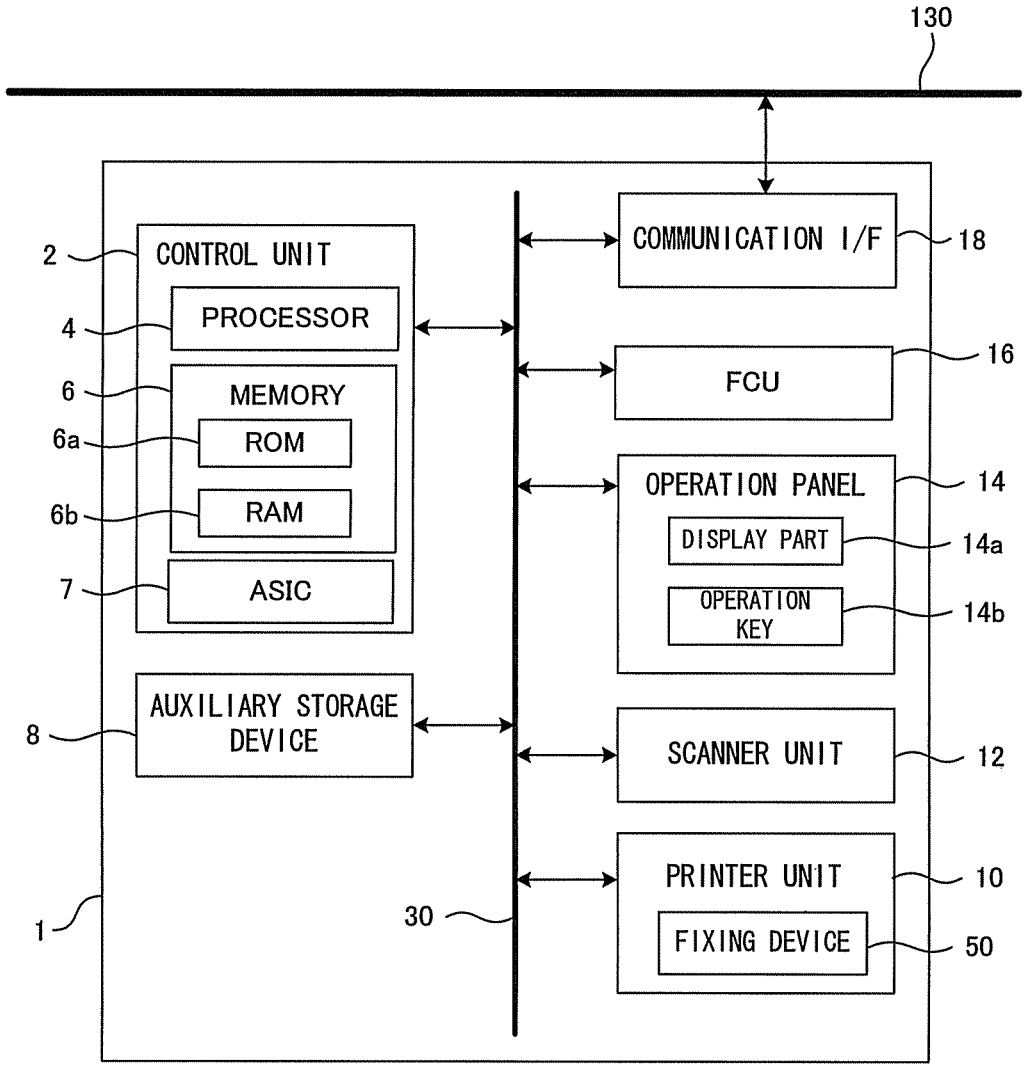
FIG. 1 is a block diagram illustrating the configuration of an image forming apparatus according to an embodiment.

FIG. 1 is a block diagram illustrating the configuration of an image forming apparatus 1 of the embodiment. The image forming apparatus includes a control unit 2, an auxiliary storage device 8, a printer unit 10, a scanner unit 12, an operation panel 14, a facsimile control unit (FCU) 16, and a communication interface (communication I/F) 18. The components of the image forming apparatus 1 are connected through a bus 30. The image forming apparatus 1 is connected to a network 130 through the communication I/F 18 and is connected with an external device, such as a client terminal or a server, through the network 130.

The control unit 2 is operated by a processor 4, a memory 6, and an operating system (OS).

The processor 4 is a CPU (Central Processing Unit) or an MPU (Micro Processing Unit).

The memory 6 is a so-called main storage. The memory 6 is a semiconductor memory, for example. The memory 6 includes a ROM (Read Only Memory) **6*a* that stores a control program of the processor 4 and a RAM (Random Access Memory) 6*b* that provides a temporary operation space for the processor 4**.

The control unit 2 can control the printer unit 10, the scanner unit 12, the operation panel 14, the FCU 16, and the communication I/F 18 by allowing the processor 4 to operate by reading the control program or the like stored in the ROM **6*a* or the auxiliary storage device 8, and also controls a fixing device 50, which is described below. Further, the control unit 2 may have various image processing functions. Further, the control unit 2 may include an ASIC (Application Specific Integrated Circuit) 7 that implements some of or the entire function of the image forming apparatus 1**.

The auxiliary storage device 8 stores application programs and the OS. The application programs include a program that executes the functions of the image forming apparatus 1, that is, a copy function, a print function, a scanner function, a facsimile function, and a network file function. The application programs further include an application for a web client (web browser) or another application. Further, the auxiliary storage device 8 stores image data generated when the scanner unit 12 reads a copy or data acquired from an external device connected to the communication I/F 18 through the network.

The auxiliary storage device 8 may be, for example, a magnetic-storage device, such as a hard disc drive, an optical storage device, a semiconductor storage device (flash memory or the like), or a combination of these devices.

The printer unit 10 forms an image corresponding to the image data of the copy, which is read by the scanner unit 12, or an image corresponding to data transmitted from a client terminal, such as an external computer 120, through the network 130, on a sheet. The printer unit 10 is equipped with the fixing device 50, a process unit that forms toner images for different-colored toners having a photo conductor on an intermediate transfer body or a transferring device that transfers the toner images formed on a sheet by the process unit.

Figure 2:
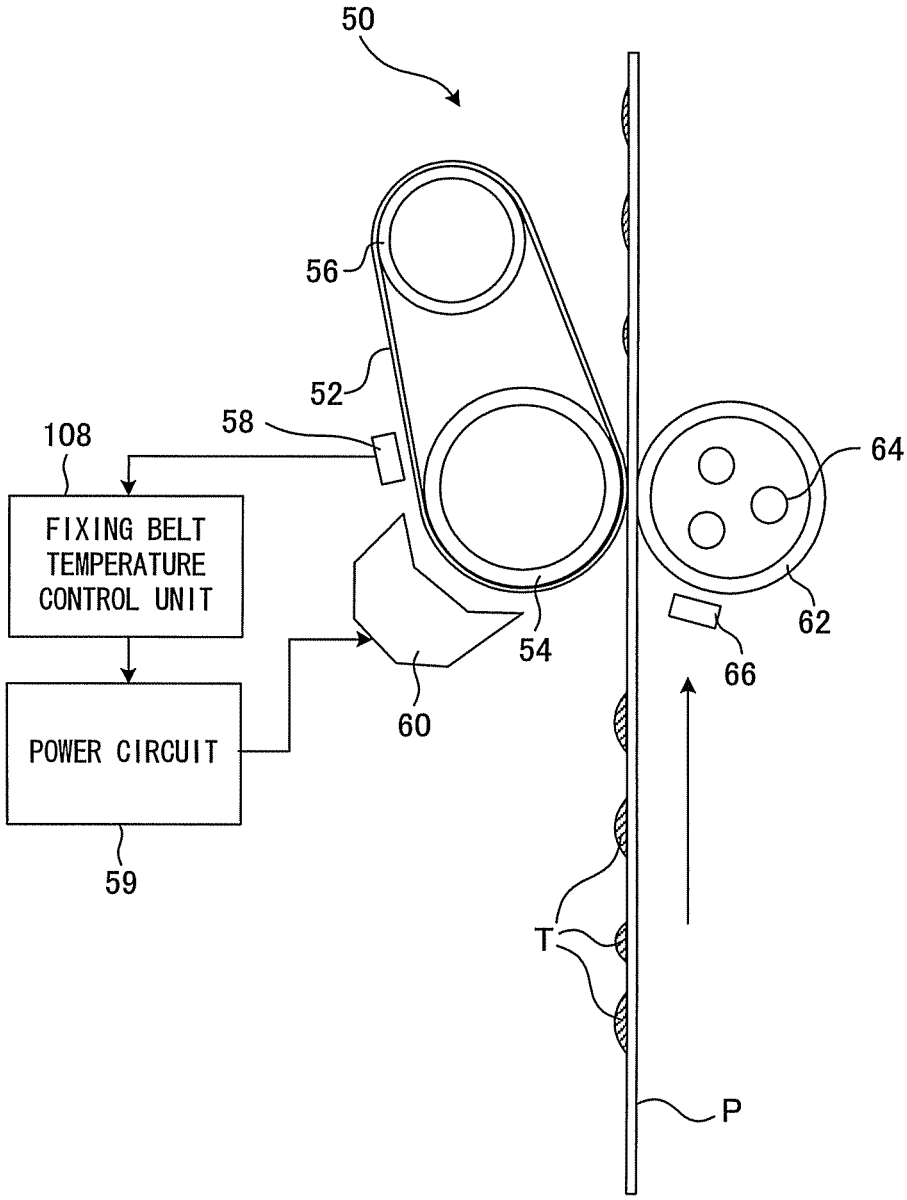
FIG. 2 is a block diagram showing the configuration of fixing device according to an embodiment.

The configuration of the fixing device 50 will be described. FIG. 2 shows the configuration of the fixing device 50 according to the embodiment.

The fixing device 50 includes a fixing belt 52 that is a heating rotary body, a fixing roller 54, a tension roller 56, a temperature sensor 58, a power circuit 59, an induction heating coil 60 that is a heating member, a pressure roller 62 that is a pressing body, and a heater 64.

The fixing belt 52 is an endless belt that is wound and rotated around two rollers, the fixing roller 54 and the tension roller 56, and conveys a sheet together with the opposite pressure roller 62, with the sheet interposed therebetween. Further, the fixing belt 52 is heated by the induction heating coil 60 and melts the toner on the interposed-conveyed paper by using the heat, such that the toner is fixed on the sheet.

The fixing roller 54 is a roller where the fixing belt 52 is wound and disposed opposite to the pressure roller 62. The fixing roller 54 fixes the heated and molten toner onto the sheet by applying a pressing force to the conveyed paper together with the opposite pressure roller 62.

The tension roller 56 is a roller that is disposed in parallel with the fixing roller 54, with the fixing belt 52 wound and suspended thereon, and applies predetermined tension to the fixing belt 52. The tension roller 56, for example, is biased by an elastic member, such as a coil spring or a leaf spring, and applies tension to the fixing belt 4.

The temperature sensor 58 measures the surface temperature of the fixing belt 52.

The power circuit 59 supplies current to the induction heating coil 60. Further, supplying or cutting the current or the current supply amount of the power circuit 59 is controlled by a fixing belt temperature control unit 108, which is described below, such that the power circuit 59 can control the temperature of the fixing belt 52.

The induction heating coil 60 heats the fixing belt 52 by generating magnetic flux by using the current supplied from the power circuit 59, and generating current in the fixing belt 52 having a conductive layer to heat, by using the magnetic flux.

The pressure roller 62 is in press-contact with the fixing belt 52 such that a uniform nip width is maintained, together with the fixing belt 52 wound and suspended on the opposite fixing roller 54 by a pressure mechanism that is not shown, such that the pressure roller 62 interposes and conveys the sheet P in cooperation with the belt surface of the fixing belt 52.

The heater 64 heats the pressure roller 62. It is possible to reliably perform fixing in the fixing device 50 at a desired fixing temperature, by heating the pressure roller 62.

A pressure roller temperature sensor 66 measures the temperature of the surface of the pressure roller 62 heated by the heater 64. The heater 64 is controlled on the basis of the result measured by the pressure roller temperature sensor 66, such that the temperature of the pressure roller 62 is adjusted.

The configuration of the fixing device 50 is as described above. Further, the fixing belt 52 and the heating roller 62 can be placed in contact with or adjacent to each other by the contacting and separating mechanism, which is not shown.

Next, a method of controlling the fixing device 50 is as the image forming apparatus 1 of the embodiment is described.

Figure 3:
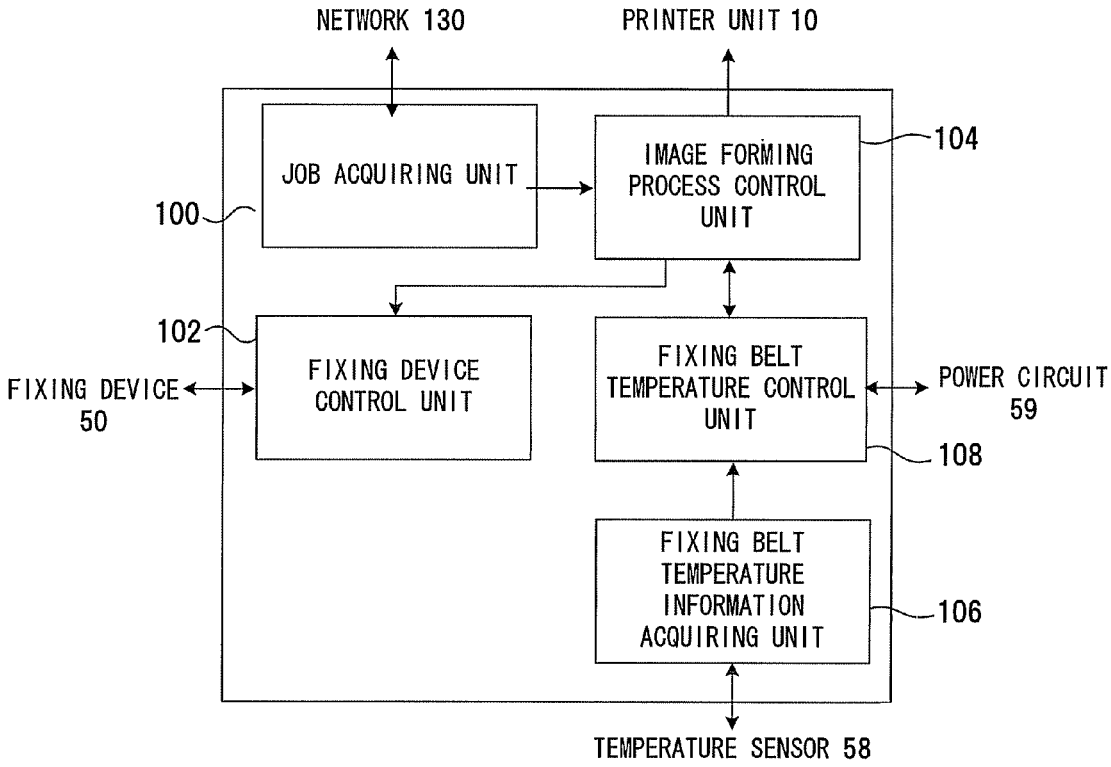
FIG. 3 is a functional block diagram showing the function of the image forming apparatus.

FIG. 3 is a function block diagram illustrating the function of the image forming apparatus 1 of the embodiment. The image forming apparatus 1 of the embodiment includes a job acquiring unit 100, a fixing device control unit 102, an image forming process control unit 104, a fixing belt temperature information acquiring unit 106, and a fixing belt temperature control unit 108.

The job acquiring unit 100 acquires an image forming job that gives instructions for the performance of image forming, from a client terminal through the network 130. As the image forming job, there may be an image forming job that directly connects a storage medium, such as a flash memory, to the image forming apparatus 1 and directly prints data in the storage medium, or a copy job that performs copying.

The fixing device control unit 102 controls the operation of the fixing device 50. In detail, when the job acquiring unit 100 acquires an image forming job, the fixing belt 52 is rotated by driving a motor (not shown) that rotates the fixing roller 54 (or the tension roller 56). Further, the fixing belt 52 (or the pressure roller 62) is placed in contact with or separated from the pressure roller 62 (or fixing belt 52) by driving the mechanism that contacts or separates the fixing belt 52 and the pressure roller 62. Further, when the operational state of the image forming apparatus 1 is switched into a sleep state where power is not supplied to the fixing device 50 by non-operating over a predetermined time or operational input from the operation panel 14, the fixing device control unit 102 stops power supply to the fixing device 50.

When the job acquiring unit 100 acquires an image forming job, the image forming process control unit 104 performs an image forming process in the printer unit 10 on the basis of the acquired image forming job.

The fixing belt temperature information acquiring unit 106 acquires temperature information showing the surface temperature of the fixing belt 52 from the temperature sensor 58 described above.

The fixing belt temperature control unit 108 controls the temperature of the fixing belt 52. In detail, the temperature of the fixing belt 52 is adjusted to a desired temperature by adjusting the current supplied to the induction heating coil 60, by controlling the power circuit 59 supplying current to the induction heating coil 60 on the basis of the temperature of the fixing belt 52 acquired by the fixing belt temperature information acquiring unit 106.

For example, when performing fixing that fixes toner actually transferred on the sheet, the fixing belt temperature control unit 108 performs a process of adjusting the temperature such that the temperature of the fixing belt 52 becomes the fixing temperature that is the temperature required for the fixing. Further, when the operational state of the image forming apparatus 1 is switched into a ready (stand-by) state where the image forming apparatus does not perform the image forming process but stands by to be able to immediately start fixing when an image forming job is generated, the fixing belt temperature control unit 108 controls the temperature of the fixing belt 52 to be the ready temperature set for the ready state. The ready temperature can be set in advance to a predetermined temperature at which an image forming process can be immediately started when an image forming job is generated, by maintaining the temperature.

Figure 4:
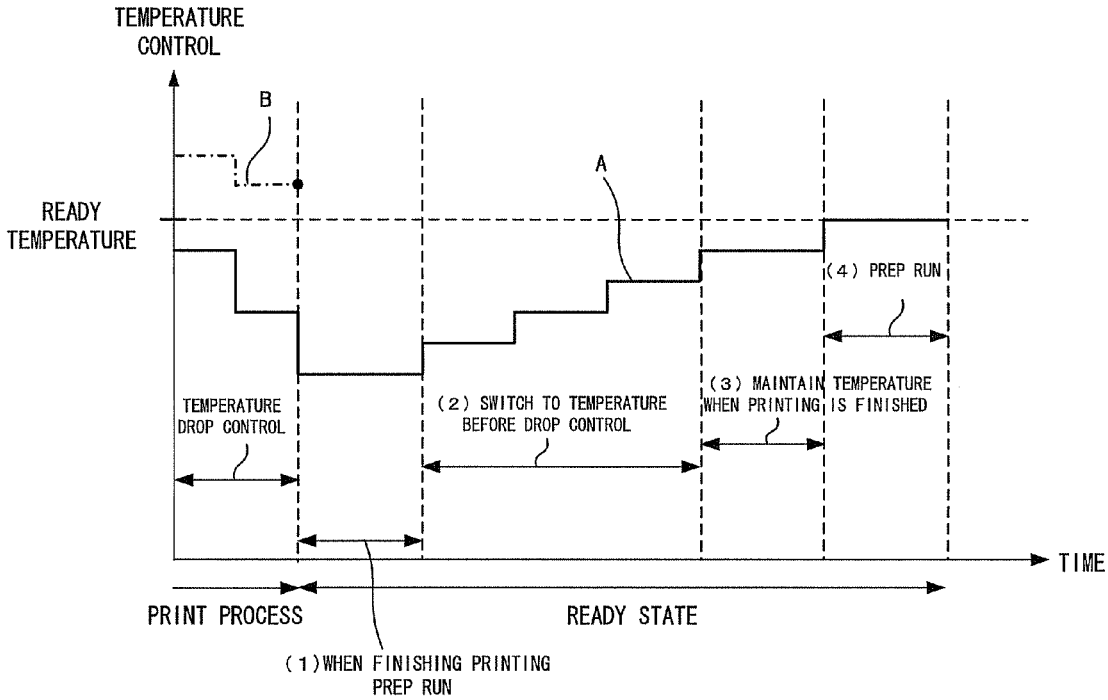
FIG. 4 is a timing chart showing control timings in the fixing device that is in a stand-by state.

Here, description will be made of the fact that control of the fixing device 50, which is switched into the ready state after the image forming job is performed, is implemented by the fixing device control unit 102 and the fixing belt temperature control unit 108 of the embodiment. FIG. 4 is a timing chart showing control timings in the fixing device 50 that is in a ready state.

The timing chart of FIG. 4 shows the passing of time on the horizontal axis and control temperature of the fixing belt 52 on the vertical axis. The control temperature is the desired temperature of the fixing belt 52 which is achieved when the fixing belt temperature control unit 108 controls the power circuit 59 such that the fixing belt 52 is heated by the induction heating coil 60. For example, when the ready temperature is 170° C. in FIG. 4, the fixing belt temperature control unit 108 heats the fixing belt 52 by controlling the power circuit 59 such that the temperature of the fixing belt 52 reaches 170° C., in pre-run control of (4).

First, A of the timing chart of FIG. 4 is described. In the timing chart A, printing that is an image forming process is performed, and temperature drop control is performed at the end of the printing period in order to prevent overshoot in which the temperature of the fixing belt 52 exceeds the ready temperature due to the subsequent ready control. In the temperature drop control, for example, the temperature of the fixing belt 52 is decreased by rotating the fixing belt 52, with the fixing belt 52 not heated.

Further, in the timing chart A, the fixing belt 52 is controlled to a temperature lower than the ready temperature, at the timing at which the printing is finished. In this case, the fixing device control unit 102 and the fixing temperature control unit 108 perform ready control (first stand-by control) for restoring the temperature of the fixing belt 52 to the ready temperature, unless the next image forming job is waiting. As the ready control restoring the temperature to the ready temperature, for example, the temperature control of (1) to (4) shown in FIG. 4 is sequentially performed.

First, the fixing device control unit 102 performs a process, which is (1) a pre-run when printing is finished and which rotates the fixing belt 52 and the pressure roller 62 in contact with each other. Next, the fixing belt temperature control unit 108 performs control of restoring temperature to the temperature before performing the temperature drop control, which is shown in (2). Next, the fixing belt temperature control unit 108 performs control of maintaining the temperature restored by the control of (2), which is shown in (3). Next, the fixing belt temperature control unit 108 performs pre-run control for reaching the ready temperature. By the control described above, it is possible to accurately restore the temperature of the fixing belt 52 to the ready temperature, after finishing printing.

Further, in the ready control for reaching the ready temperature of (1) to (4), the fixing device control unit 102 heats the fixing belt 52 by using the induction heating coil 60 while controlling the fixing belt 52 to rotate. Therefore, the entire circumference of the fixing belt 52 can be uniformly heated.

Meanwhile, when printing is finished and the temperature of the fixing belt 52 is the ready temperature or higher, the fixing device control unit 102 and the fixing belt temperature control unit 108 of the embodiment perform control (second stand-by control) without performing the control (1) to (4) described above. That is, as shown in B indicated by a dashed line of FIG. 4, when printing is finished and the temperature of the fixing belt 52 is higher than the ready temperature, the fixing belt temperature control unit 108 does not heat the fixing belt 52 by using the induction heating coil 60. Further, the fixing device control unit 102 stops the rotation of the fixing belt 52 and the pressure roller 62. When printing is finished and the temperature of the fixing belt 52 is the ready temperature or higher, even if an image forming job is generated and an image forming process is started, the temperature of the fixing belt does not decrease with respect to the fixing temperature and fixing can be restarted.

Further, although FIG. 4 exemplifies an example that performs the temperature drop control before switching to the ready state, it is not necessary to always perform the temperature drop control. Regardless of whether to perform the temperature drop control, when printing is finished and the state is switched into the ready state and the fixing belt temperature control unit 108 determines that the temperature of the fixing bet 52 is the ready temperature or higher, the control of the ready state is not performed, and when the temperature of the fixing belt 52 is lower than the ready temperature, the control for the ready state maybe performed.

The above description is the configuration and the function of the image forming apparatus 1 of the embodiment.

According to the image forming apparatus 1 of the embodiment, when the state is switched into the ready state and the temperature of the fixing belt 52 is higher than the ready temperature, restoring to the ready temperature that is performed while the pressure roller 62 rotates in press-contact with the fixing belt 52 is not performed. By the control described above, it is possible to reduce the time when the pressure roller 62 rotates in press-contact with the fixing belt 52 after printing is finished, in comparison to the related art.

Accordingly, for example, when scraps or fragments of a sheet stick to the pressure roller 62, the fragments of the sheet stick to the surface of the pressure roller 62 due to the rotation of the pressure roller 62 in press-contact with the fixing belt 52 when common control of the ready state is performed. However, when the control of the embodiment is performed, since the time when both rotate in press-contact with each other is small, it is possible to prevent the sticking of the fragments of the sheet. When fragments of a sheet stick to the pressure roller 62, the fragments or scraps sticking to the pressure roller 62 stick to the surface, which faces the pressure roller 62, of the sheet passing the fixing device 50 to perform fixing, which becomes a factor that causes taints on the rear surface of the sheet and is not preferable.

Figure 5:
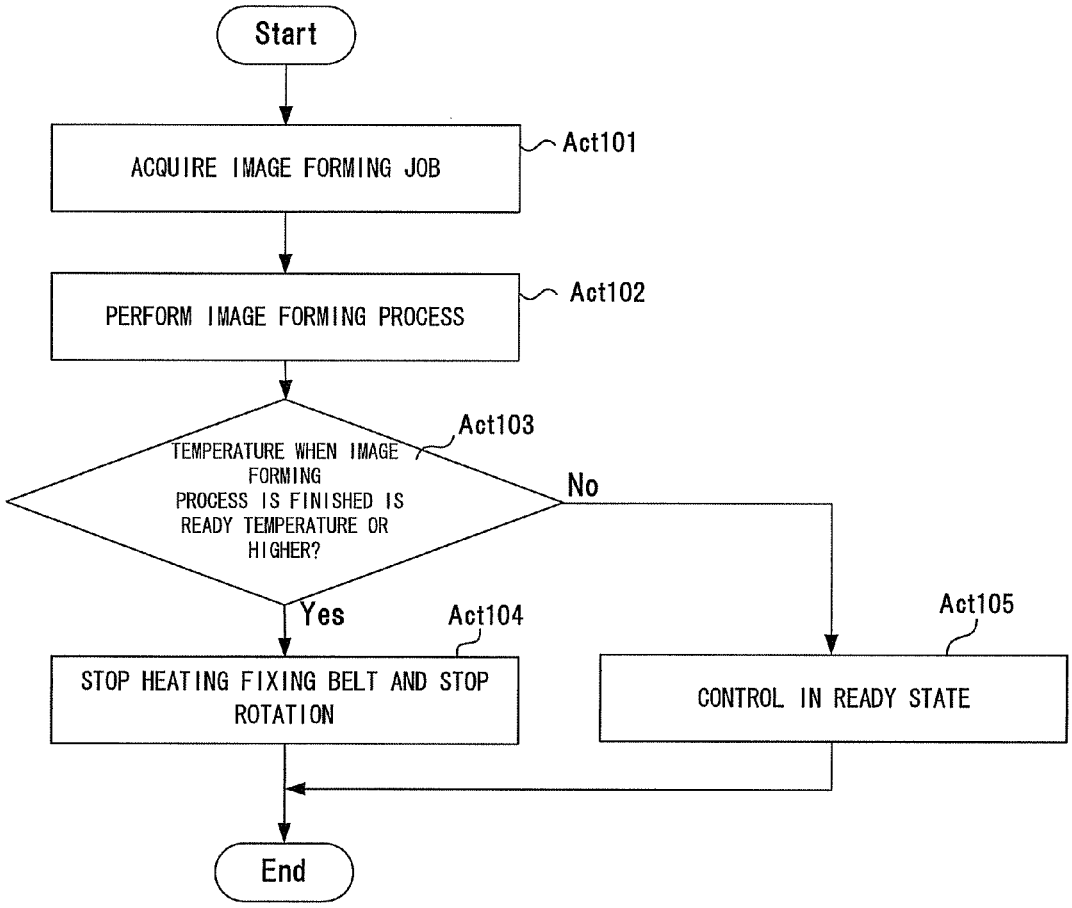
FIG. 5 is a flowchart illustrating the flow of control of the fixing device in the image forming apparatus according to an embodiment.

Next, the flow of control of the fixing device 50 in the image forming apparatus 1 of the embodiment is described. FIG. 5 is a flowchart illustrating the flow of control of the fixing device 50 in the image forming apparatus 1.

First, the job acquiring unit 100 acquires an image forming job (Act 101).

Next, the image forming process control unit 104 performs the image forming process in the printer unit 10 on the basis of the image forming job that the job acquiring unit 100 acquires (Act 102). In this operation, the fixing device control unit 102 or the fixing belt temperature control unit 108 performs fixing at the fixing temperature by controlling the fixing device 50.

Next, when the image forming process based on the image forming job is finished and the state is switched into the ready state, the fixing belt temperature control unit 108 determines whether the temperature of the fixing belt 52 acquired by the fixing belt temperature information acquiring unit 106 from the temperature sensor 58 is the ready temperature or higher (Act 103).

When it is determined that the temperature of the fixing belt is the ready temperature or higher (Yes in Act 103), the fixing device control unit 102 and the fixing belt temperature control unit 108 do not perform the control for the ready state (Act 104). That is, the fixing device control unit 102 stops the rotation of the fixing belt 52 and the temperature control unit 108 stops power supply from the power circuit 59 to the induction heating coil 60, such that heating the fixing belt 52 is stopped (second stand-by control). Thereafter, for example, when the job acquiring unit 100 acquires an image forming job, the image forming process control unit 104 performs the image forming job and the fixing device control unit 102 or the like makes the fixing device 50 perform fixing. Further, when an image forming job is not generated over a predetermined time, the image forming apparatus 1 may perform control for switching to a mode that consumes less power (for example, sleep mode).

Meanwhile, when it is determined that the temperature of the fixing belt is lower than the ready temperature (No in Act 103), the fixing device control unit 102 and the fixing belt temperature control unit 108 perform control for the ready state (first stand-by control) (Act 105). The control for the ready state is control of increasing the temperature of the fixing belt 52 up to the ready temperature, by heating the fixing belt 52 with the induction heating coil 60 while rotating the fixing belt 52, as described above.

Further, although it is described that the fixing device 50 is equipped with the fixing belt 52, as a heating rotary body, in the embodiment, it is not limited thereto. The fixing roller may be used as the heating rotary body. Even in the fixing roller, it is possible to prevent the rear surface of a sheet from being tainted.

As described above, according to an embodiment, it is possible to provide an image forming apparatus that can form an image without tainting a sheet.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

a fixing device including a heating rotary body that fixes toner onto a sheet by heating the toner on the sheet, a pressing body that forms a nip portion between the heating rotary body and the pressing body, and conveys the sheet in cooperation with the heating rotary body, with the sheet interposed therebetween, and a heating member that heats the heating rotary body;

a job acquiring unit that acquires an image forming job that gives instructions for performing forming of an image;

an image forming process control unit that controls performance of the image forming job that the job acquiring unit acquires;

a temperature information acquiring unit that acquires information showing temperature of the heating rotary body;

a determining unit that determines whether the temperature of the heating rotary body which is acquired by the temperature information acquiring unit is equal to or larger than a predetermined stand-by temperature set as a temperature in a stand-by state that stands by to perform the image forming process, when temperature drop control is completed, the temperature drop control being performed for decreasing the temperature of the heating rotary body when the image forming process corresponding to one image forming job is completed; and a fixing device control unit, which controls the fixing device, that performs the temperature drop control, performs a first stand-by control process that increases the temperature of the heating rotary body from a temperature at completion of the temperature drop control to the stand-by temperature in stages by heating the heating rotary body with the heating member while rotating the heating rotary body with the heating rotary body and the pressing body in contact, when the determining unit determines that the temperature of the heating rotary body at completion of the temperature drop control is lower than the stand-by temperature, and performs a second stand-by control process that stops the rotation of the heating rotary body and makes the fixing device stand by, without heating the heating rotary body with the heating member, when the determining unit determines that the temperature of the heating rotary body at completion of the temperature drop control is at the stand-by temperature or higher.

2. The apparatus according to claim 1, wherein the heating rotary body is an endless belt wound and suspended to a plurality of rollers.

3. The apparatus according to claim 1, wherein the heating member heats the heating rotary body by induction heating.

4. The apparatus according to claim 3, wherein the heating member is disposed outside the heating rotary body and heats the heating rotary body by induction heating from the outside of the heating rotary body.

5. The apparatus according to claim 1, wherein the fixing device control unit heats the heating rotary body to a stand-by temperature, through heating control to at least one desired temperature between a temperature of the heating rotary body when the image forming process is completed and the stand-by temperature, as first stand-by control.

6. The apparatus according to claim 1, wherein the fixing device control unit heats the heating rotary body up to the temperature of the heating rotary body when the temperature drop control is started, and then heats at the stand-by temperature, as first stand-by control.

7. A control method in an image forming apparatus including a fixing device including a heating rotary body that fixes toner onto a sheet by heating the toner on the sheet, a pressing body that forms a nip portion between the heating rotary body and the pressing body, and conveys the sheet in cooperation with the heating rotary body, with the sheet interposed therebetween, and a heating member that heats the heating rotary body, the method comprising:

acquiring an image forming job that gives instructions for performing forming of an image;

controlling performance of the acquired image forming job;

acquiring information showing temperature of the heating rotary body;

performing temperature drop control for decreasing the temperature of the heating rotary body when the image forming process corresponding to one image forming job is completed, determining whether the acquired temperature of the heating rotary body is equal to or larger than a predetermined stand-by temperature set as a temperature in a stand-by state that stands by to perform the image forming process, when the temperature drop control is completed; and performing a first stand-by control process that increases the temperature of the heating rotary body from a temperature at completion of the temperature drop control to the stand-by temperature in stages by heating the heating rotary body with the heating member while rotating the heating rotary body with the heating rotary body and the pressing body in contact, when it is determined that the temperature of the heating rotary body at completion of the temperature drop control is lower than the stand-by temperature, and performing a second stand-by control process that stops the rotation of the heating rotary body and makes the fixing device stand by, without heating the heating rotary body with the heating member, when it is determined that the temperature of the heating rotary body at completion of the temperature drop control is at the stand-by temperature or higher.

8. The method according to claim 7, wherein the heating rotary body is an endless belt wound and suspended to a plurality of rollers.

9. The method according to claim 7, wherein the heating member heats the heating rotary body by induction heating.

10. The method according to claim 9, wherein the heating member is disposed outside the heating rotary body and heats the heating rotary body by induction heating from the outside of the heating rotary body.

11. The method according to claim 7, wherein the first stand-by control is control of heating the heating rotary body to a stand-by temperature, through heating control to at least one desired temperature set between a temperature of the heating rotary body when the image forming process is completed and the stand-by temperature, as first stand-by control.

12. The method according to claim 7, wherein the first stand-by control is control of heating the heating rotary body up to the temperature of the heating rotary body when the temperature drop control is started, and then heating at the stand-by temperature.

13. A non-transitory computer-readable recording medium that causes a computer to execute a control process in an image forming apparatus including a fixing device including a heating rotary body that fixes toner onto a sheet by heating the toner on the sheet, a pressing body that forms a nip portion between the heating rotary body and the pressing body, and conveys the sheet in cooperation with the heating rotary body, with the sheet interposed therebetween, and a heating member that heats the heating rotary body, the control process comprising:

acquiring an image forming job that gives instructions for performing forming of an image;

controlling performance of the acquired image forming job;

acquiring information showing temperature of the heating rotary body;

performing temperature drop control for decreasing a temperature of the heating rotary body when the image forming process corresponding to one image forming job is completed, determining whether the temperature of the heating rotary body is equal to or larger than a predetermined stand-by temperature set as a temperature in a stand-by state that stands by to perform the image forming process, when the temperature drop control is completed; and performing a first stand-by control process that increases the temperature of the heating rotary body from a temperature at completion of the temperature drop control to the stand-by temperature in stages by heating the heating rotary body with the heating member while rotating the heating rotary body with the heating rotary body and the pressing body in contact, when it is determined that the temperature of the heating rotary body at completion of the temperature drop control is lower than the stand-by temperature, and performs a second stand-by control process that stops the rotation of the heating rotary body and makes the fixing device stand by, without heating the heating rotary body with the heating member, when it is determined that the temperature of the heating rotary body at completion of the temperature drop control is at the stand-by temperature or higher.

14. The recording medium according to claim 13, wherein the heating rotary body is an endless belt wound and suspended to a plurality of rollers.

15. The recording medium according to claim 13, wherein the heating member heats the heating rotary body by induction heating.

16. The recording medium according to claim 15, wherein the heating member is disposed outside the heating rotary body and heats the heating rotary body by induction heating from the outside of the heating rotary body.

17. The recording medium according to claim 13, wherein the first stand-by control heats the heating rotary body to a stand-by temperature, through heating control to at least one desired temperature set between temperature of the heating rotary body when the image forming process is completed and the stand-by temperature, as first stand-by control.

* * * * *